United States Patent [19]

De Mets

[11] Patent Number: 4,565,509

[45] **Date of Patent: * Jan. 21, 1986**

[54] CONTINUOUS OPERATION PRESS

[75] Inventor: Albert De Mets, Roeselaare, Belgium

[73] Assignee: Constructiewerkhuizen De Mets N.V., Izegem/Kachtem, Belgium

[ * ] Notice: The portion of the term of this patent subsequent to Dec. 13, 2000 has been disclaimed.

[21] Appl. No.: 621,044

[22] Filed: Jun. 15, 1984

[30] Foreign Application Priority Data

Jun. 16, 1983 [EP] European Pat. Off. ..... 83105939.9

[51] Int. Cl.[4] ..... B30B 5/06

[52] U.S. Cl. ..... 425/101; 425/371; 425/406

[58] Field of Search ..... 425/101, 371, 135, 224, 425/335, 406; 264/169

[56] References Cited

U.S. PATENT DOCUMENTS

| | | | |
|---|---|---|---|
| 3,057,376 | 10/1962 | Agutter et al. | 137/594 |
| 3,779,686 | 12/1973 | Kerttula et al. | 425/406 |
| 3,860,368 | 1/1975 | Kerttula et al. | 425/406 |
| 4,420,299 | 12/1983 | De Mets | 425/101 |

*Primary Examiner*—Peter Kratz
*Assistant Examiner*—Jill Fortenberry
*Attorney, Agent, or Firm*—Collard, Roe & Galgano

[57] ABSTRACT

A continuous operation press for the manufacture and treatment of a board web of prefabricated or raw material, wherein the board web is passed into an inlet region between the upper and lower stringers of upper and lower endless belts traveling at a predetermined velocity in the transport direction, wherein there is provided a smooth coating formed with grooves serving as a sliding surface located at least in the main press and calibration regions. The board web glides above the smooth coating with the aid of fluid lubricant, the lubricant being supplied to the smooth coating through supply openings and discharged therefrom through discharge openings. Each groove in the smooth coating is formed with an opening therein either as a supply or discharge opening, each groove having a lubricant supply opening being positioned adjacent a groove having a lubricant discharge opening. Means are provided for controlling the pressure in at least some of said grooves for generation of a counter-pressure.

32 Claims, 2 Drawing Figures

CONTINUOUS OPERATION PRESS

Figure 1:
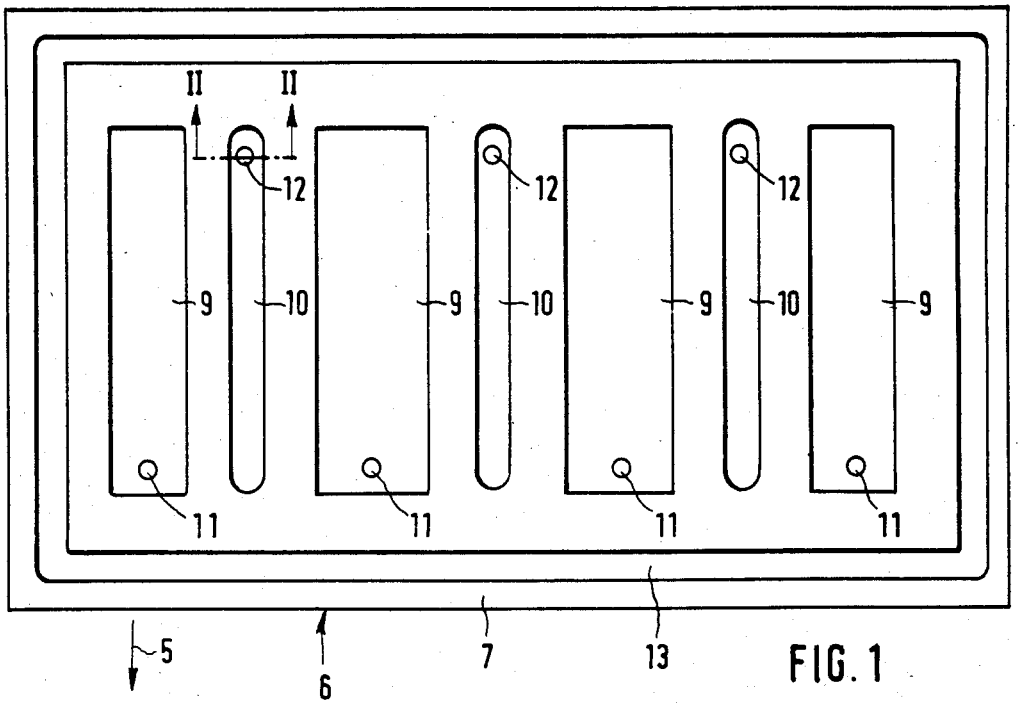

The present invention relates to a continuous operation press for the manufacture and/or coating, treating, etc. of a single layer or multi-layer board web made of a prefabricated material and/or raw material.

Such a press is shown and described in U.S. Pat. No. 4,420,299, granted Dec. 13, 1983, to the applicant herein, the subject matter of which is herein incorporated by reference. However, a problem with the press of this prior patent relates to the non-uniformity of the compressed film resulting from the sliding means or lubricant across the length or width of the pressure region, and consequently also the temperature distribution, when the sliding means is heated or cooled.

It is, therefore, an object of the present invention to further develop the smooth coating of such a press, which acts as a sliding surface, in such a manner that the compressed film generated from the sliding means and extending over an entire surface, and consequently the temperature distribution of the sliding means, as well as of the goods to be treated, is made more uniform. This object is accomplished in accordance with the present invention by providing in the smooth coating of the press a single lubricant inlet opening in each groove throughout the entire system, said grooves being substantially uniformly distributed and overlapping in partial segments with the result that the partial fields are fully filled with lubricant, which is under pressure.

The sliding means or lubricant receives the surface forces acting on the board web within the region of the groove. Simultaneously, the sliding means is pressed into the region between the board web and the smooth coating, serving as a sliding surface, in the form of a compressed very uniform manner. Controlling the pressure in the respective groove formed with the discharge opening results in that just in this region, part of the surface forces acting on the board web or on the smooth coating, are also received by the sliding means at a pressure distribution which is made more uniform. As a consequence, there results a very uniform pressure distribution in all partial segments of the compressed films as well as an extraordinarily low coefficient of friction. Furthermore, a correspondingly uniform temperature distribution of the sliding means and also of the treated goods results.

In a preferred embodiment of the present invention, a securement of the smooth coating or of its partial segments through the grooves is established, instead of using separate securement means at other locations. As a result, the effective surface area available for the sliding means or lubricant is not diminished, so that greater surface forces are avoided which would result in wear due to shearing forces and hence less durability and shorter operating life.

Other objects and features of the present invention will become apparent from the following detailed description considered in connection with the accompanying drawing. It is to be understood, however, that the drawing is designed as an illustration only and not as a definition of the limits of the invention.

Figure 2:
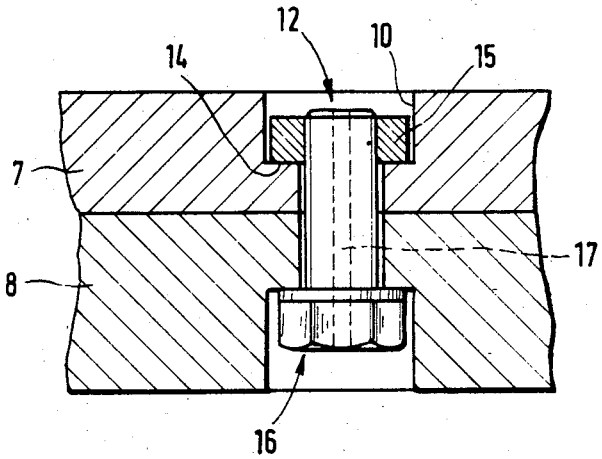

In the drawing wherein similar reference characters denote similar elements throughout the several views:

FIG. 1 is a plan view of a segment of the smooth coating, acting as a sliding surface, according to the present invention; and FIG. 2 is a schematic and partially fragmented cross-sectional view through the segment of the smooth coating of FIG. 1.

Now turning to the drawings, there is shown in FIG. 1 a smooth coating, designated 7, which extends on the rear side of each steel endless belt, traveling in transport direction s, of a continuous operation press. As previously indicated, such a press is disclosed in U.S. Pat. No. 4,420,299, granted Dec. 13, 1983, the disclosure of which is incorporated herein by reference. Smooth coating 7 is partitioned into partial segments 6 which are supported on and secured to counter-support 8 (see FIG. 2).

Each partial segment 6 of smooth coating 7, which acts as a sliding surface and is preferably formed of polytetrafluoroethylene, is formed with small grooves 9 and 10, extending parallel to one another and to the direction of transport 5.

Each of the grooves 9 and 10 are formed with a single opening 11 and 12, respectively, which, in the case of adjoining grooves 9 and 10 of respective unequal dimensions, are disposed on respective opposite ends thereof. As clearly seen, groove 10 is provided with a smaller dimension than groove 9.

The openings implemented as lubricant supply openings 11 lie, as viewed in the direction of transport 5, behind discharge openings 12, which are disposed at the opposite ends of groove 10. In each partial segment 6, grooves 9 in smooth coating 7, which are formed with supply openings 11, as well as smaller grooves 10 in smooth coating 7, of the partial segment 6, which are formed with discharge openings 12, are surrounded by a peripheral groove 13, which delineates each partial segment 6. As illustrated in FIG. 1, peripheral groove 13 is shown not to have any openings therein, however, it can be provided with a discharge opening 12.

FIG. 2 is a fragmentary cross-sectional view of the partial segment 6 which shows the groove 10 having discharge opening 12. Groove 10 is shown to have a rectangular cross sectional shape, however it may also be semi-circular, square, etc. As clearly seen in FIG. 2, there is a flat metal plate 15 extending on base 14 of groove 10, which is threadably engaged with counter-support 8 by means of at least one screw 16. The metal plates 15 have been omitted from FIG. 1 for the sake of clarity.

At least one securing screw 16 in each groove, as clearly seen in FIG. 2, is implemented as a nozzle having a pressure control function and, as shown, includes a schematically illustrated nozzle channel 17 (shown in phantom). Such a securing screw 16, implemented as a nozzle, is furthermore used in the other grooves 9 and 10 not only as a discharge opening 12, but also as a supply opening 11. This pressure control function may also be accomplished by a pressure control valve, a stop or a choke.

While only a single embodiment of the present invention has been shown and described, it will be obvious that many changes and modifications may be made thereto without departing from the spirit and scope of the invention.

What is claimed is:

1. In a continuous operation press for the manufacture and treating of a board web of prefabricated or raw material, particularly of a non-woven material treated with binding means and containing lignol-cellulose or cellulose-containing particles, such as wood chips and wood fibers, the board web is passed into an inlet region of a lower endless steel belt and an upper endless steel belt, which travel at a predetermined velocity in a transport direction, wherein there is provided a smooth coating formed with grooves serving as a sliding surface located at least in the main press region and the calibration region disposed downstream therefrom, the smooth coating is supported on a lower countersupport and on an upper countersupport, the board web gliding above the smooth coating with the aid of fluid lubricant which may serve as a heat transfer medium, the supply of said fluid lubricant being under pressure, the lubricant being supplied to the smooth coating through supply conduits and supply openings and discharged therefrom through discharge openings and discharge conduits, the lubricant being recirculated and optionally heated or cooled, the improvement comprising: each groove in the smooth coating being formed with one opening therein for the lubricant supply and lubricant discharge, each groove having a lubricant supply opening being positioned adjacent a groove having a lubricant discharge opening, and means are provided for controlling the pressure in at least some of said grooves for generation of a counter-pressure.

2. The press according to claim 1, wherein said grooves extend substantially parallel to one another.

3. The press according to claim 1, wherein said grooves extend parallel to the transport direction.

4. The press according to claim 1, wherein said grooves formed with supply and discharge openings are of unequal dimension.

5. The press according to claim 1, wherein the opening in each groove is formed at an end thereof.

6. The press according to claim 5, wherein the supply opening and the discharge opening of two adjoining grooves are disposed on different respective ends thereof with respect to the transport direction.

7. The press according to claim 6, wherein said supply openings are disposed ahead of said discharge openings in the direction of transport.

8. The press according to claim 1, wherein said pressure control means comprises a pressure control device provided in each discharge conduit for generating a counter-pressure in the groove formed with the discharge opening.

9. The press according to claim 1, wherein said pressure control means comprises a pressure control device arranged in the region of the discharge opening of each respective groove for generating a counter-pressure for the lubricant.

10. The press according to claim 1, wherein said pressure control means comprises each discharge opening including a pressure control device.

11. The press according to claim 1, wherein said pressure control means comprises a pressure control device provided in each supply conduit.

12. The press according to claim 1, wherein said pressure control means comprises a pressure control device provided in the region of the supply opening of each respective groove.

13. The press according to claim 1, wherein said pressure control means comprises each said supply opening including a pressure control device.

14. The press according to claim 1, wherein the pressure control means is a pressure control valve.

15. The press according to claim 1, wherein the pressure control means is a stop.

16. The press according to claim 1, wherein the pressure control means is a choke.

17. The press according to claim 1, wherein the pressure control means is a nozzle.

18. The press according to claim 1, wherein said smooth coating is partitioned into partial segments containing said grooves.

19. The press according to claim 18, wherein a plurality of partial segments are provided along the transport direction and transversely thereto.

20. The press according to claim 19, wherein said smooth coating is formed of polytetrafluoroethylene.

21. The press according to claim 20, wherein each partial segment includes an endless groove within which said grooves formed with supply and discharge openings are disposed.

22. The press according to claim 21, which further comprises a metal plate disposed on the base of each groove, said metal plate extending along the groove, and being threadable onto the countersupport by means of attachment screws.

23. The press according to claim 22, wherein said metal plate includes a multiplicity of threaded bores for receiving said attachment screws.

24. The press according to claim 22, wherein one of the attachment screws in each groove formed with a supply opening is implemented as a supply opening having a through-going bore.

25. The press according to claim 22, wherein one of the attachment screws in each groove formed with a discharge opening is implemented as a discharge opening having a through-going bore.

26. The press according to claim 25, wherein one of the attachment screws in each groove is implemented as a nozzle.

27. The press according to claim 25, wherein one of the attachment screws in each groove is implemented as a choke.

28. The press according to claim 1, wherein said grooves have a rectangular cross section.

29. The press according to claim 1, wherein said grooves have a semi-circular cross section.

30. The press according to claim 1, wherein said grooves have a quadratic cross section.

31. The press according to claim 4, wherein the groove formed with a discharge opening is smaller than the groove formed with the supply opening.

32. The press according to claim 1, wherein individual supply and discharge openings, on each side in relation to the transport direction, are selectably closeable for the purpose of being matched to different respective operating widths of the goods to be treated.

* * * * *